United States Patent [19]

Hindman

[11] 4,144,691

[45] Mar. 20, 1979

[54] PATIO ROOF

[76] Inventor: Milo F. Hindman, #15 Evergreen, Centralia, Ill. 62801

[21] Appl. No.: 854,897

[22] Filed: Nov. 25, 1977

Related U.S. Application Data

[62] Division of Ser. No. 702,193, Jul. 2, 1976, Pat. No. 4,077,175.

[51] Int. Cl.[2] ..... E04B 5/52

[52] U.S. Cl. ..... 52/461; 52/484; 52/486

[58] Field of Search ..... 52/22, 461, 484, 486, 52/90

[56] References Cited

U.S. PATENT DOCUMENTS

| | | | |
|---|---|---|---|
| 2,307,653 | 1/1943 | Wright | 52/486 |
| 3,307,314 | 3/1967 | Varlonga | 52/461 |
| 3,848,385 | 11/1974 | Thompson | 52/484 |
| 3,984,959 | 10/1976 | Wasson | 52/22 X |

*Primary Examiner*—J. Karl Bell

*Attorney, Agent, or Firm*—Rogers, Eilers & Howell

[57] ABSTRACT

A roof, that is constituted by a number of contiguous three-dimensional roof pans, has fascia-supporting clips adjacent one side thereof; and has a fascia releasably held by those clips. That fascia also extends along the ends of that roof. The opposite side of the roof is supported by a flashing-like bracket; and that bracket has a shelf-like bottom which extends under, and which is secured to, the roof pans to enable the weight of that opposite side to tend to draw that bracket into intimate engagement with that opposite side. The one side of the roof is underlain and supported by an elongated channel which, in turn, is supported by vertically-directed posts. The upper ends of those posts extend upwardly through openings in a horizontally-directed lower portion of that channel and are co-extensive with, and are directly secured to, the vertically-directed portion of that channel. The undersurfaces of the roof pans have undercut recesses therein which accommodate hangers; and sheets of insulation which are supported by those hangers constitute a ceiling.

2 Claims, 16 Drawing Figures

FIG. 1.
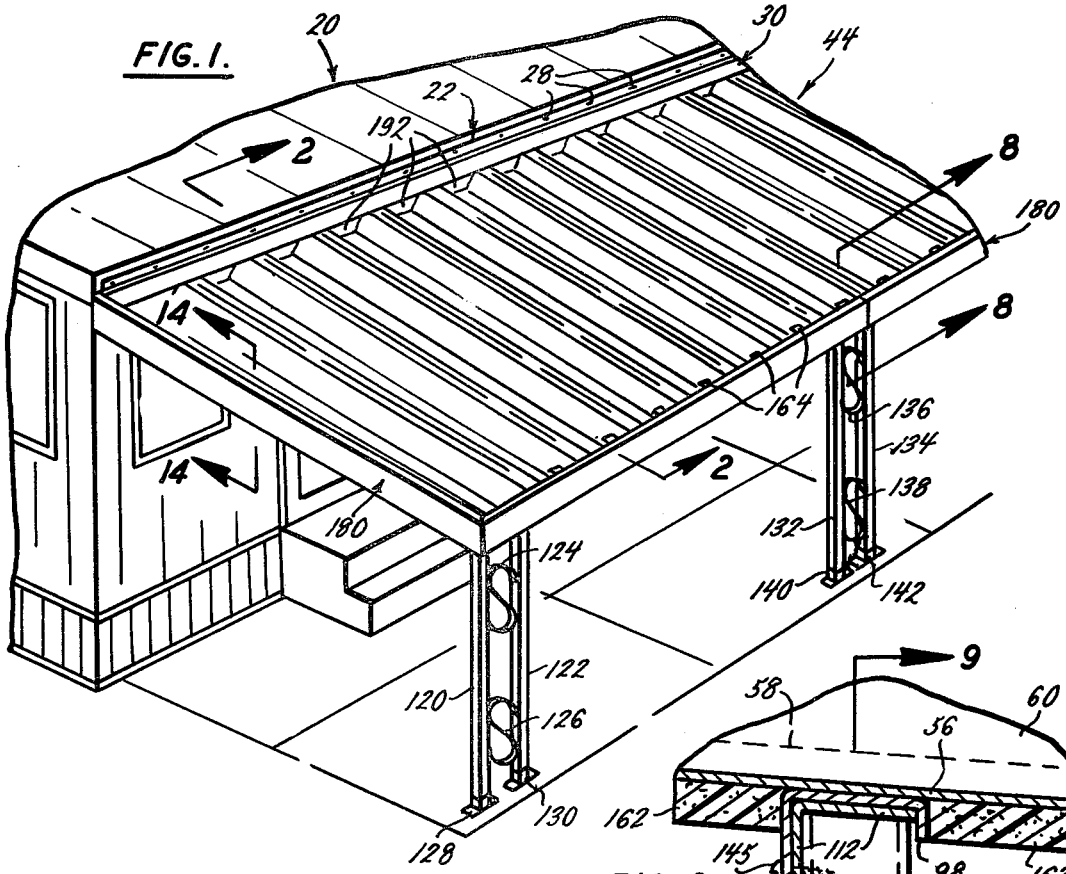
FIG. 8.
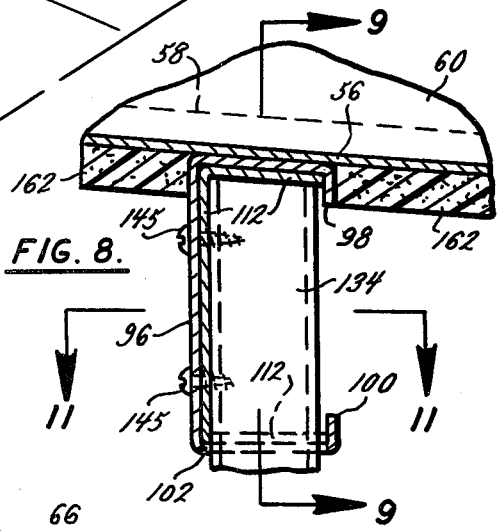
FIG. 10.
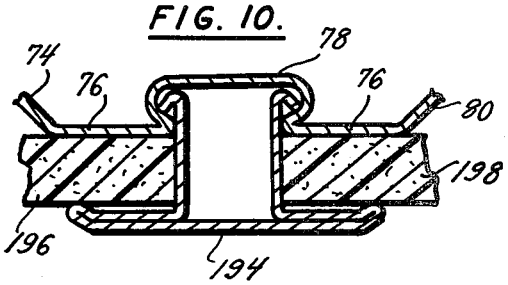
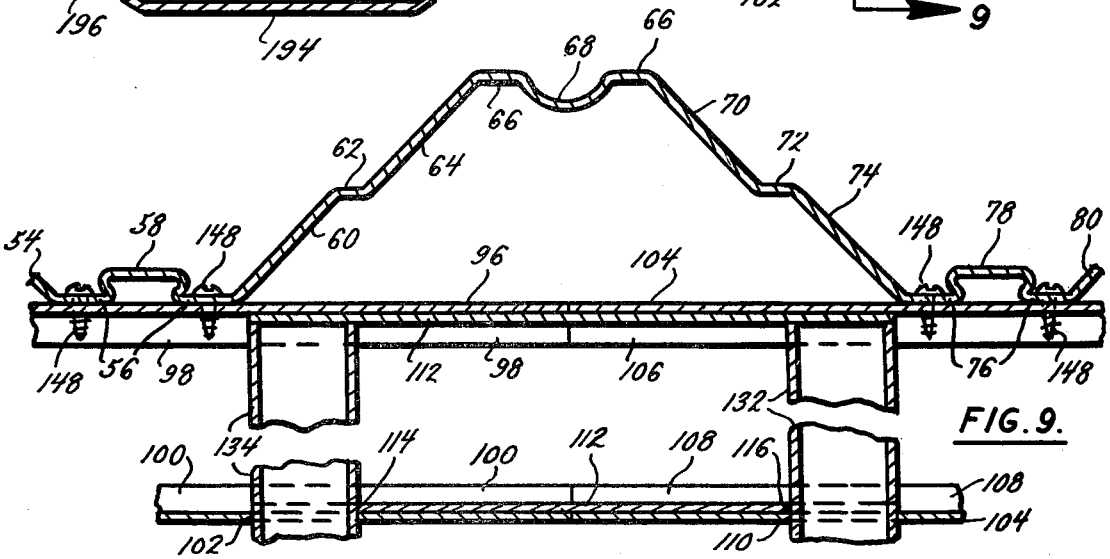
FIG. 9.

PATIO ROOF

This is a division of application Ser. No. 702,193 filed July 2, 1976, now U.S. Pat. No. 4,077,175.

FIELD OF THE INVENTION

This invention relates to roofs for patios and porches. Such roofs frequently are made from sheet metal roof pans that are bent to make those roofs three-dimensional. A three-dimensional roof for a patio or porch usually has a fascia at one side thereof to provide a neat and attractive appearance for that side. The opposite side of such a roof usually is supported by a flashing-like bracket; and the fascia-equipped side of such a roof usually is supported by an underlying elongated member which is held by posts.

SUMMARY OF THE INVENTION

A roof, that is constituted by a number of contiguous three-dimensional roof pans, has fascia-supporting clips adjacent one side thereof; and has a fascia releasably held by those clips. That fascia also extends along the ends of that roof. Those clips have arms with confronting notches therein; and those notches accommodate and telescope over spaced edges of the roof pans. Those clips must be stressed to dispose those notches in telescoping engagement with those edges; and the resulting restorative forces within those clips will prevent accidental separation of those clips from the roof pans. It is, therefore, an object of the present invention to provide a fascia-supporting clip with confronting notches in the arms thereof which accommodate and telescope over spaced edges of a roof pan to prevent accidental separation of that clip from that roof pan.

A side of the roof is supported by a flashing-like bracket; and that bracket has a shelf-like bottom which extends under, and which is secured to, the roof pans that constitute the roof. The points of attachment of that shelf-like bottom to those roof pans are so located that the weight of that side of the roof will apply forces to that bracket which will tend to draw that bracket into intimate engagement with that side. As a result, the engagement between the bracket and the roof tends to be slack-free and solid. It is, therefore, an object of the present invention to provide a flashing-like bracket with a shelf-like bottom which extends under a side of a roof, and which is secured to that side in such a way that the forces which that side applies to that bracket will tend to draw that bracket into intimate engagement with that side.

A further side of the roof is underlain and supported by an elongated channel which, in turn, is supported by vertically-directed posts. The upper ends of those posts extend upwardly through openings in a horizontally-directed lower portion of that channel and are co-extensive with, and are directly secured to, the vertically-directed portion of that channel. As a result, rigid and solid connections are provided between those posts and that roof. It is therefore, an object of the present invention to provide an elongated channel which underlies a further side of the roof, which has openings in the horizontally-directed lower portion thereof, and which has the upper ends of posts extending upwardly through those openings to be co-extensive with, and to be directly secured to, the vertically-directed portion of that channel.

The roof pans of the roof have undercut recesses therein which accommodate hangers; and sheets of insulation which are supported by those hangers constitute a ceiling. That ceiling provides a finished appearance for the undersurface of the roof, and it also helps insulate that roof. It is, therefore, an object of the present invention to provide undercut recesses in the undersurfaces of roof pans, to provide hangers which are accommodated by those recesses, and to suspend sheets of insulation from those hangers to constitute a ceiling.

Other and further objects and advantages of the present invention should become apparent from an examination of the drawing and accompanying description.

In the drawing and accompanying description a preferred embodiment of the present invention is shown and described but it is to be understood that the drawing and accompanying description are for the purpose of illustration only and do not limit the invention and that the invention will be defined by the appended claims.

BRIEF DESCRIPTION OF THE DRAWING

In the drawing,

FIG. 1 is a perspective view of a roof for a patio adjacent a mobile home,

FIG. 8 is a sectional view, on the scale of FIG. 2, through the roof of FIG. 1 and through the supporting channel therefor, and it is taken along the plane indicated by the line 8—8 in FIG. 1, FIG. 9 is a sectional view, on the scale of FIG. 2, through the roof and two of the posts of FIG. 1, and through the supporting channel of FIG. 8, and it is taken along the plane indicated by the line 9—9 in FIG. 8, FIG. 10 is a sectional view, on an even larger scale, through the roof of FIG. 1 and through sheets of insulation used therewith, and it shows an alternate form of hanger used with that roof.

DETAILED DESCRIPTION OF THE PREFERRED EMBODIMENT

Figures 2, 3, 4, 5, 6, 7:
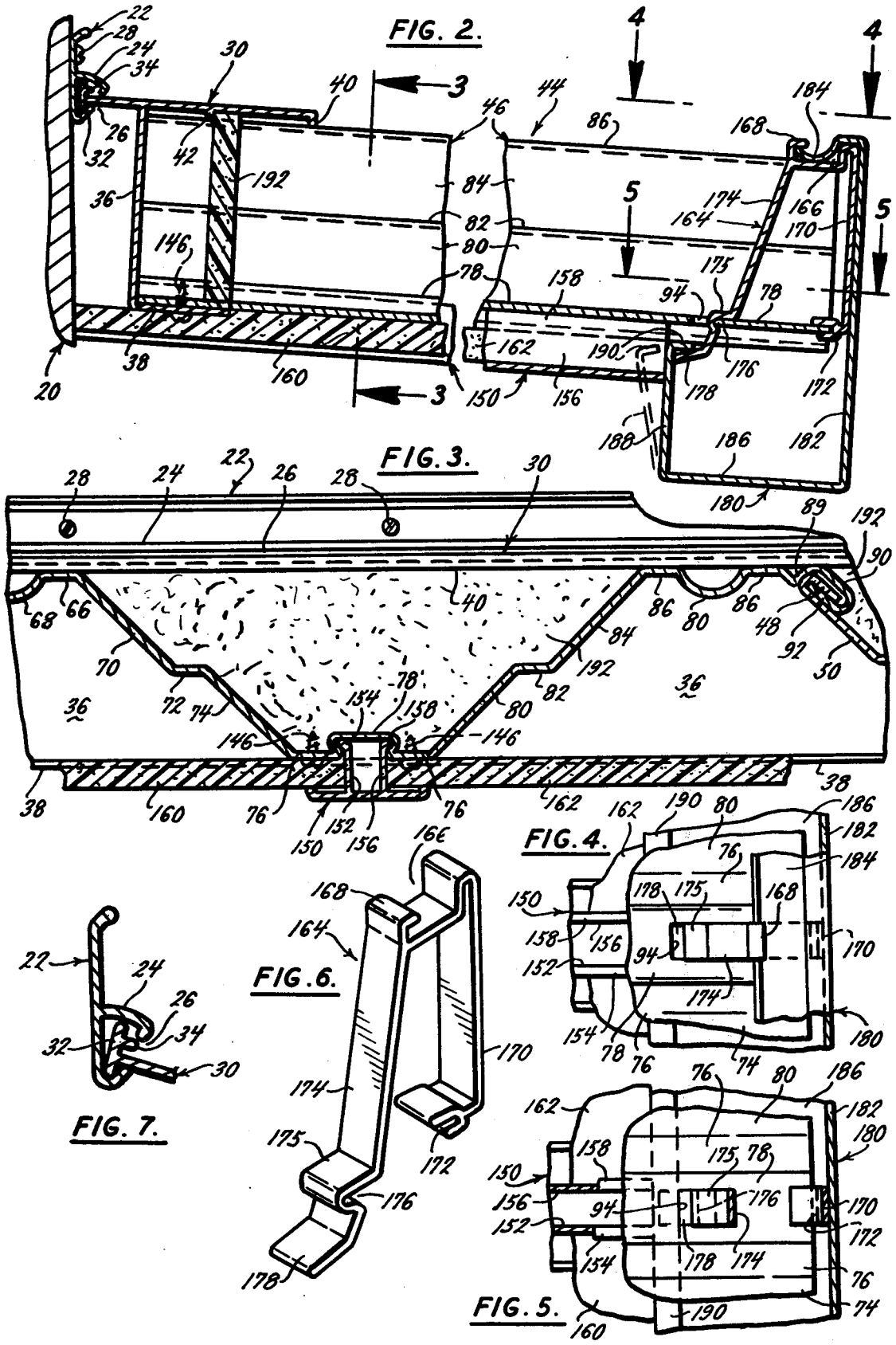
FIG. 2 is a broken sectional view, on a larger scale, through the roof of FIG. 1, and it is taken along the plane indicated by the line 2—2 in FIG. 1.
FIG. 3 is a sectional view, on the scale of FIG. 2 through a portion of the roof of FIG. 1, and it is taken along the plane indicated by the line 3—3 of FIG. 2.
FIG. 4 is a broken-away plan view, on the scale of FIG. 2, of another portion of the roof of FIG. 1, and it is taken along the plane indicated by the line 4—4 in FIG. 2.
FIG. 5 is a sectional view, on the scale of FIG. 2, through the roof of FIG. 1, and it is taken along the plane indicated by the line 5—5 in FIG. 2.
FIG. 6 is a perspective view, on an even larger scale, of one of the fascia-supporting clips used with the roof of FIG. 1.
FIG. 7 is a sectional view, on the scale of FIG. 2, through a portion of the roof of FIG. 1, and it is taken along a plane parallel to that indicated by the line 2—2 in FIG. 1.

Referring to the drawing in detail, the numeral 20 generally denotes a mobile home which has a patio adjacent one side thereof. The numeral 22 generally denotes an elongated supporting bracket which is secured to an upper portion of that side of the mobile home by screws 28, as shown particularly by FIG. 2. Also as shown particularly by FIG. 2, that supporting bracket has a generally-triangular section 24 adjacent the lower end thereof; and an elongated slot 26 is provided in one wall of that generally-triangular section.

The numeral 30 generally denotes an elongated, flashing-like bracket which has a longitudinally-extending flange 32 thereon that is shallow enough and thin enough to be telescoped end wise into the generally-triangular section 24 of the supporting bracket 22. A longitudinally-extending lip 34 is provided on the flange 32 to strengthen and stiffen that flange. A longitudinally-extending, downwardly-directed wall 36 is spaced outwardly from the flange 32; and hence is spaced outwardly from the supporting bracket 22 and the adjacent side of the mobile home 20. A longitudinally-extending shelf-like bottom 38 extends outwardly from the lower edge of the downwardly-directed wall 36; and, as shown particularly by FIG. 2, that shelf-like bottom is parallel to the top of the flashing-like bracket 30. A longitudinally-extending shallow lip 40 extends downwardly from the outer edge of the upper portion of that flashing-like bracket; and a longitudinally-extending shallow stop 42 extends downwardly from an intermediate portion of the undersurface of that upper portion. The lip 40 is located outwardly relative to the outer edge of the shelf-like bottom 38, but the stop 42 is generally in register with that outer edge, as shown particularly by FIG. 2.

Figure 16:
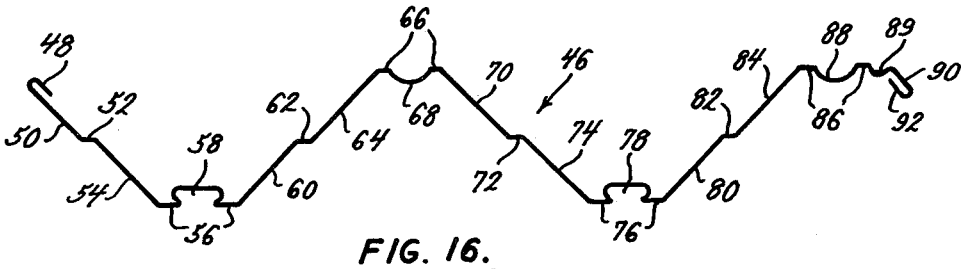
FIG. 16 is an end view, on a smaller scale, through one of the roof pans of the roof of FIG. 1.

The numeral 44 generally denotes a roof which overlies the patio adjacent the side of the mobile home 20, as shown particularly by FIG. 1. That roof includes a number of roof pans which are generally denoted by the numeral 46; and one of those roof pans is shown in end view in FIG. 16. Each full-width roof pan has a re-entrant edge 48, a downwardly-inclined portion 50, an offset 52, a further downwardly-inclined portion 54, a lower portion 56 which has an undercut recess 58 extending upwardly therefrom, an upwardly-inclined portion 60, an offset 62, a further upwardly-inclined portion 64, an upper portion 66 which has a semi-cylindrical concave groove 68 therein, a downwardly-inclined portion 70, an offset 72, a further downwardly-inclined portion 74, a lower portion 76 which has an undercut recess 78 extending upwardly therefrom, an upwardly-inclined portion 80, an offset 82, a further upwardly-inclined portion 84, an upper portion 86 with a semi-cylindrical concave groove 88 therein, a stop like portion 89, a downwardly-inclined portion 90, and a re-entrant edge 92. The re-entrant edge 48 of one roof pan will interfit with the re-entrant edge 92 of an adjacent roof pan, as emphasized particularly by FIG. 3; but the space between the downwardly-inclined portion 90 and the re-entrant edge 92 is greater than the thickness of the re-entrant edge 48. This is desirable because it will keep capillary action from causing moisture to work its way into the space between the downwardly-inclined portion 90 and the re-entrant edge 92. The lower portions 56 and 76 are identical, the upper portions 66 and 86 are identical, the undercut recesses 58 and 78 are identical, and the semi-cylindrical concave grooves 68 and 88 are identical. The offsets 52, 62, 72 and 82 are identical; and the downwardly-inclined portions 50 and 70 differ from each other only in that the downwardly-inclined portion has the re-entrant edge 48. The upwardly-inclined portions 64 and 84 are identical; and the upwardly-inclined portions 60 and 80 are identical. The downwardly-inclined portions 54 and 74 are identical.

In one preferred embodiment of the present invention, the vertical distance from the plane of the upper portions 66 and 86 to the plane of the lower portions 56 and 76 is three inches. The width of each of those upper portions is about two and three-eighths inches, and the width of each of those lower portions is about two and three-eighths inches. The width of each offset 52, 62, 72 and 82 is about one-half of an inch, and the overall width of the roof pan 46 from the re-entrant edge 48 to the re-entrant edge 92 is about twenty and three-quarters inches. The depth of each undercut recess 58 and 78 is about five-sixteenths of an inch; and the depth of each semi-cylindrical, concave groove 68 and 88 is about five-sixteenths of an inch. Because the roofing pans 46 have such a configuration, they can be quite strong and yet be made of thin gauge metal.

The numeral 94 denotes a rectangular opening which is provided in each of the undercut recesses 58 and 78 close to the front of the roof pan 46. In the said one preferred embodiment of the present invention, that opening is three-eighths of an inch long in a direction parallel to that undercut recess and is five-eighths of an inch long in a direction transverse of the axis of that recess. The distance between the nearest edge of that opening and the front edge of the roof pan 46 is two and one-eighth inches.

The numeral 96 denotes a C-shaped channel which has a downwardly-directed lip 98 adjacent the free edge of the upper flange thereof, and which has an upwardly-directed lip 100 adjacent the free edge of the lower flange thereof. The numeral 102 denotes a rectangular opening in the lower flange of channel 96, as shown particularly by FIGS. 8 and 9. The numeral 104 denotes a further C-shaped channel which has a downwardly-directed lip 106 adjacent the free edge of the upper flange thereof, and which has an upwardly-directed lip 108 adjacent the free edge of the lower flange thereof. The numeral 110 denotes a rectangular opening in the lower flange of the channel 104, as shown particularly by FIG. 9. The channels 96 and 98 are identical to each other except for the locations of the openings 102 and 110 therein. As indicated by FIG. 8, the upper flange 96 is displaced eighty-five degrees from the plane of the web of that channel; and hence the free edges of that channel are spaced apart a distance less than the height of that web.

Figure 11:
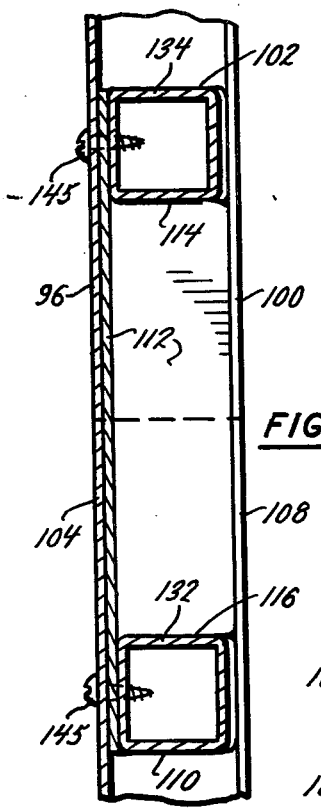
FIG. 11 is a sectional view, on the scale of FIG. 2, through the posts and the elongated channel of FIG. 9, and it is taken along the plane indicated by the line 11—11 in FIG. 8.
Figure 12:
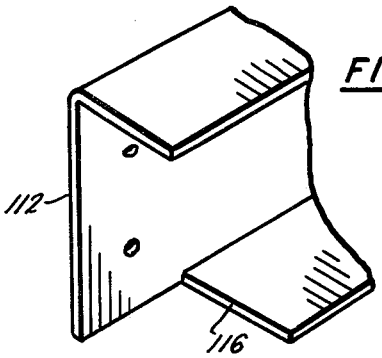
FIG. 12 is a perspective view, on a larger scale, of a connector which is used to interconnect adjacent sections of the elongated channel of FIG. 9.
Figure 13:
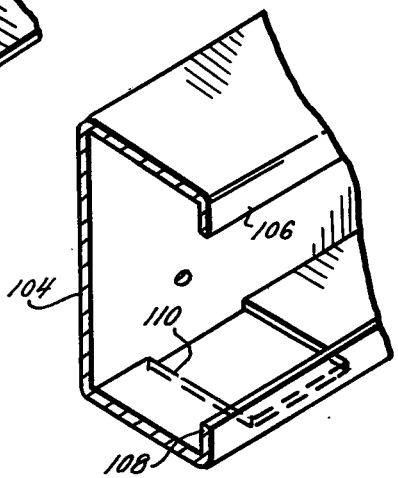
FIG. 13 is a perspective view, on the scale of FIG. 12, of a portion of the elongated channel of FIG. 9.

The numeral 112 denotes a channel-like connector which is dimensioned to fit within the confronting ends of the channels 96 and 104, as indicated particularly by FIGS. 8, 9 and 11. As shown by FIG. 12, the connector 112 has no lips at the free edges of the flanges thereof. That connector has a generally-rectangular notch 116 at one end of the lower flange thereof, as shown by FIG. 12; and that notch is disposable in register with the opening 110 in the channel 104. A further generally-rectangular notch 114 is provided at the other end of the lower flange of connector 112; and that notch is disposable in register with the opening 102 in the channel 96. As indicated by FIG. 8, the upper flange of that connector is displaced eighty-five degrees from the plane of the web of that connector.

The numeral 120 denotes a vertically-directed post which is shown as being hollow and as having a square cross section. The numeral 122 denotes a similar post; and cross pieces 124 and 126 are secured to the confronting faces of these posts to hold those confronting faces in fixedly spaced-apart relation. Those cross pieces are shown as being ornamental in form and configuration. The upper ends of the posts 120 and 122 extend upwardly through rectangular openings, not shown, in the lower flange of the channel 104; and those openings will be similar to the opening 110. Flanged sockets 128 and 130 receive the lower ends of the posts 120 and 122; and the flanges of those sockets will be suitably secured to the patio at the side of the mobile home 20.

The numerals 132 and 134 denote posts which can, and preferably will, be identical to the posts 120 and 122. The numerals 136 and 138 denotes cross pieces which can, and preferably will, be identical to the cross pieces 124 and 126. The upper end of the post 132 extends upwardly through the opening 110 in the lower flange of channel 104, through the rectangular notch 116 in the lower flange of connector 120, and is located close to the upper flange of that connector, as shown particularly by FIG. 9. The upper end of the post 134 extends upwardly through the opening 102 in the lower flange of channel 96, through the rectangular notch 114 in the lower flange of connector 112, and is located close to the upper flange of that connector, as shown particularly by FIGS. 8 and 9. Self-tapping screws 145 extend through the vertically-directed portions of channel 96 and of connector 112 to seat in the upper end of post 134; and those screws will solidly interconnect that channel and that connector to each other and to that post. Similar screws extend through the vertically-directed portions of channel 104 and of connector 112 to seat in the upper end of post 132; and those screws will solidly interconnect that channel and that connector to each other and to that post. Flanged sockets 140 and 142 receive the lower ends of the posts 132 and 134; and the flanges of those sockets will be suitably secured to the patio at the side of the mobile home 20.

The edges of the roof pans 46, which confront the side of the mobile home 20, are telescoped into position between the upper portion and the shelf-like bottom 38 of the flashing-type bracket 30, as shown particularly by FIG. 2. The lower portions 56 and 76 of each roof pan rest upon that shelf-like bottom, and the upper portions 66 and 86 underlie and are engaged by the lip 40 and they underlie the stop 42. Where that stop is shallower than that lip, the manufacturing tolerances used in defining the vertical distance from the plane of those upper portions to the plane of those lower portions can be looser than when that stop and that lip have the same depth. The lip 40 is about three-sixteenths of an inch deep and it holds the undersurface of the upper portion of the flashing-type bracket 30 above, and out of engagement with, the upper portions 66 and 86 of each roof pan. That arrangement is important; because it keeps capillary action from causing moisture to work its way into the space between that undersurface and the upper portions 66 and 86. Self-tapping screws 146 extend upwardly through the shelf-like bottom 38 of the flashing-type bracket 30 to seat in the lower portions 56 and 76 of each of the roof pans, as indicated particularly by FIGS. 2 and 3. Those screws and the stop 42 are located the same distances from the downwardly-directed wall 36, as shown by FIG. 2; and hence those screws are disposed outwardly of the joint between that wall and the upper portion of the flashing-type bracket 30. Those screws localize the points of transfer of gravitational forces from the roof pans 46 to the flashing-type bracket 30; and, because those screws are located outwardly of the joint between the upper portion and the wall 36 of that bracket, those gravitational forces tend to pull the lower portion of that wall into intimate engagement with the adjacent edges of those roof pans. As a result, the locations of the screws 146 coact with the configuration of the flashing-type bracket 30 to assure an intimate and solid engagement between the wall 36 of that bracket and the adjacent edges of the roof pans.

Self-tapping metal screws 148 extend downwardly through the lower portions 56 and 76 of the various roof pans to seat in openings in the upper flanges of the channels 96 and 104. The screws 146 coact with the flashing-type bracket 30 and with the elongated bracket 22 to solidly secure the upper edges of the roof pans 46 to the mobile home 20; and the screws 148 coact with the channels 96 and 104 and with the posts 120, 122, 132 and 134 to solidly secure the lower edges of those roof pans to the patio.

The numeral 150 denotes an inverted T-shaped hanger; and that hanger is shown particularly by FIGS. 3–5. That hanger has upstanding webs 152 and 156 which are spaced apart a distance comparable to the narrowest width of either of the undercut recesses 58 and 78. A lip 154 is provided at, and extends laterally outwardly from, the upper edge of the web 152; and a similar lip 158 is provided at, and extends laterally outwardly from, the upper edge of the web 156, as shown particularly by FIG. 3. Those lips are intended to fit so intimately into the undercut portions of either of the undercut recesses 58 and 78 that they can maintain the hanger 150 in position even though appreciable downwardly-directed forces are applied to that hanger. The webs 152 and 156 are made sufficiently flexible to enable the lips 154 and 158 to be moved far enough toward each other to pass upwardly into either of the undercut recesses 58 and 78; but those webs are made stiff enough to prevent accidental separation of the hanger 150 from that undercut recess.

The numeral 160 denotes a sheet of insulation which underlies the under surfaces of the lower portions 56 and 76 of the roof pans; and one edge of that sheet of insulation will overlie and be supported by the lower portion of the hanger 150. The numeral 162 denotes a similar sheet of insulation which will underlie the under-surfaces of the roof pans, and one edge of that sheet of insulation will overlie and be supported by the lower portion of the hanger 150. That hanger preferably will be fabricated as a long extruded strip; and it will then be cut to the desired length.

The numeral 164 generally denotes a fascia-supporting clip which is shown particularly by FIGS. 2, 4, 5 and 6. A notch 166 of generally-rectangular cross section is provided in the top of that clip; and a lip 168 overlies the rear edge of that notch. The numeral 170 denotes one arm of that clip; and the numeral 174 denotes another arm of that clip. As indicated particularly by FIGS. 2 and 6, those arms diverge as they extend downwardly from the notch 166. A notch 172 is provided at the lower end of the arm 170; and that notch is intended to accommodate and telescope over the front edge of either of the undercut recesses 58 and 78, as shown particularly by FIG. 2. An offset 175 is provided adjacent the lower end of the arm 174; and the lower surface of that offset is intended to rest upon the upper surface of either of the undercut recesses 58 and 78, as indicated by FIG. 2. A notch 176, which is immediately below the offset 175, confronts the notch 172 at the lower end of the arm 170; and the notch 176 is intended to accommodate the forward edge of the opening 94 in the upper surface of either of the undercut recesses 58 and 78, as indicated by FIG. 2. The numeral 178 denotes a projection which extends downwardly and rearwardly from the notch 176; and that projection is intended to extend downwardly through the opening 94 to dispose the lower end thereof below the level of the lower portion 56 or 76.

The unstressed distance between the notches 172 and 176, in the lower ends of the arms 170 and 174, respectively, is less than the distance between the front edge of the opening 94 and the front edge of the appropriate undercut recess 58 or 78. As a result, the lower ends of those arms must be forced to move further apart to set the notches 176 and 172 in engagement, respectively, with the forward edge of the opening 94 and with the forward edge of that undercut recess. The restorative forces, which develop within the clip 164 as those arms are forced to move further apart, are important in preventing accidental separation of that clip from the roof pan to which it is secured.

To secure a clip 164 to a roof pan 46, that clip will be set in a position which is displaced a few degrees in the counterclockwise direction from the position shown by FIG. 2; and then it will have the projection 178 thereof passed downwardly through the opening 94 in the appropriate undercut recess 58 or 78 until the notch 176 is in register with the forward edge of that opening. Thereafter, that clip will be rotated in the clockwise direction and will be moved forwardly until the notch 176 telescopes over that forward edge. At that time, the lower end of the arm 170 will be forced to move far enough away from the arm 174 to enable the notch 172 to be moved downwardly into register with the forward edge of the undercut recess 58 or 78. Thereupon, the restorative forces within the clip 164 will be permitted to move the notch 172 into telescoping engagement with the front edge of the undercut recess 58 or 78; and those restorative forces will actively prevent accidental separation of that clip from the roof pan to which that clip is secured.

The numeral 180 generally denotes a fascia which has a front wall 182, a rearwardly-extending lip 184 of generally-arcuate configuration at the upper edge of that front wall, a bottom 186, an upwardly-extending rear wall 188, and a forwardly-extending lip 190 at the top of that rear wall. The front wall 182 has a height which is considerably greater than that of the roof pan 46, as shown by FIG. 2. As a result, the bottom 186 of the fascia 180 is disposed an appreciable distance below the levels of the hanger 150 and of the sheets of insulation 160 and 162 which are supported by that hanger.

The fascia 180 is easily secured to the fascia-supporting clip 64, and hence to the roof 44. To secure that fascia to that clip, that fascia will be set in a position which is displaced a few degrees in the counterclockwise direction from the position shown by FIG. 2; and then the free edge of the generally-arcuate lip 184 of that fascia will be moved into the notch 164 in the top of that clip. At that time, that free end will be moved rearwardly into position between the lip 168 and the rear portion of that notch; and then that fascia will be rotated in the clockwise direction in FIG. 2 until the front wall 182 approaches the arm 170 of the clip. Such rotation of that fascia will cause the free edge of the lip 190 to underlie and abut the projection 178 on the clip; and then the installer will reach up into the space, defined by the inclined portions 60 and 74 or by other inclined portions, to move the lip 190 and the rear wall 188 to the dotted-line position of FIG. 2. At such time, the free edge of that lip will be clear of the rear edge of the projection 178; and then the fascia 180 can be caused to assume the solid-line position of FIG. 2 wherein that lip overlies the free end of that projection.

The fascia 180 will be sufficiently flexible to permit the rear wall 188 thereof to be moved to the dotted-line position of FIG. 2; and that fascia will be sufficiently resilient to spring back to the solid-line position of FIG. 2. That fascia will be stiff enough to enable the restorative forces thereof to keep accidental forces from dislodging the lip 190 from its position above the free end of the projection 178, and also to keep such forces from dislodging the lip 184 from the notch 166. As a result, the restorative forces within the fascia 180 will prevent accidental separation of the fascia from the fascia-supporting clip 164.

If the length of the roof 44 is greater than the length of a single section of fascia 180, two or more fascia sections will be used. The joint between adjacent fascia sections can be rendered waterproof in any of the ways in which the joint between adjacent sections of guttering of the same kind of metal is rendered waterproof. As a result, where two or more fascia sections must be used, they can be made to act as one elongated fascia section.

The lower end of the arm 170 of the fascia-supporting clip 164 is displaced ninety degrees from the rest of that arm; and hence that arm is generally L-shaped. That lower end displaces the rest of that arm forwardly of the notch 172, and hence forwardly of the front edge of the undercut recess 68 or 78. As a result, the front wall 182 of the fascia 180 is displaced at least five-sixteenths of an inch forwardly of the front edge of the undercut recess 58 or 78; and that displacement is important, because it permits the water from even heavy rains to pass freely beyond the front edges of the lower portions 56 and 76 of the various roof pans 46.

The bottom 186 and the lower portions of the front wall 182 and of the rear wall 188 constitute a gutter which underlies all of the openings 94 in the undercut recesses 58 and 78; and that gutter will accommodate any rain, sleet, snow or the like which passes downwardly through those openings. In addition, that gutter will accommodate all rain, sleet, snow or the like which passes downwardly through the spaces between the front edges of the various roof pans 46 and the front wall 182 of the fascia 180. That gutter will conduct water to the ends of the fascia 180; and down spouts or other devices can be provided at those ends to receive and direct that water. Rain, melted snow and the like will initially collect in the spaces between the inclined portions 74 and 80, and then will be guided toward the fascia 180 by the lower portions 56 and 76. If it ever became desirable to clean the gutter which is provided by the fascia 180, it would only be necessary to cause the rear wall 188 and the lip 190 to assume the dotted-line positions of FIG. 2 and then to rotate the fascia 180 in the counterclockwise direction until the free edge of the generally-arcuate lip 184 was freed from the lip 168 and from the notch 166 in the upper end of the clip 164. The fascia 180 preferably will be installed before the hangers 150 and the sheets 160 and 162 of insulation are installed. Where that is done, a tight and neat joint can be provided between the outer edges of those sheets of insulation and the rear wall 188 of the fascia 180.

Referring particularly to FIG. 2, the numeral 192 denotes a generally-trapezoidal weather stop that preferably is made from a closed-cell foam plastic material. The configuration of that weather stop will be generally complementary to the configuration of the space which is defined by the inclined portions 70, 74, 80 and 84, by the offsets 72 and 82, by the lower portion 76, and by the undercut recess 78 of the roof pan 46; but the dimensions of that weather stop will be slightly larger than those of that space, so that weather stop will have to be slightly compressed as it is moved into the position of FIG. 2. In that position the upper edge of that weather stop abuts the undersurface of the flashing-type bracket 30; and the lower edge of that water stop abuts the upper surfaces of the inclined portions 70, 74, 80, 84, of the offsets 72 and 82, of the lower portion 76 and of the undercut recess 78. Also in that position, the top of the rear face of that weather stop abuts the stop 42, and the bottom of that rear face abuts the screws 146; and that stop and those screws will determine the position of that weather stop.

To install the weather stop 192, it will be set in a position which is displaced a few degrees in the counterclockwise direction from the position of FIG. 2, it will have the upper edge thereof moved into close proximity to the stop 42, and then it will be rotated into the position shown by FIG. 2. Because that weather stop will be slightly compressed as it is moved into the position of FIG. 2, restorative forces will be developed in that weather stop which create frictional forces between that weather stop and the adjacent roof pan which will prevent accidental separation weather stop from the adjacent roof pan. The weather stop 192 will keep rain, snow, dust and the like from being blown past the upper edges of the various roof pans 46.

Referring particularly to FIG. 10, the numeral 194 denotes a different embodiment of inverted T-shaped hanger. That hanger resembles the hanger 150 of FIG. 3; but it is made as a rolled form rather than as an extrusion. Although the roll-forming die which is needed to make the hanger 194 is much more expensive than is the extrusion die which is needed to make the hanger 150, the hanger 194 can be rolled from suitably-colored metal. The lips at the upper edges of the webs of the hanger 194 are specifically different from, but perform the same functions as, the lips 154 and 158 at the upper edges of the webs 152 and 156 of the hanger 150. To install the hanger 194, the webs thereof must be bowed far enough toward each other to enable the lips at the upper edges of those webs to pass between the closely-adjacent, confronting portions of either of the undercut recesses 58 and 78. Thereafter, those webs can be permitted to move back toward their un-stressed positions to enable the lips thereon to engage the undercut portions of that recess. Those webs are sufficiently stiff to make the engagements between the lips thereof and the undercut portions of the recess 58 or 78 prevent accidental separation of the hanger 194 from that recess.

The numerals 196 and 198 denotes sheets of insulation which are similar to the sheets 160 and 162 of insulation. The confronting edges of the sheets 196 and 198 of insulation overlie and are supported by the lower portion of the hanger 194. Those sheets of insulation will coact with similar sheets of insulation, not shown, to constitute a ceiling.

Figure 14:
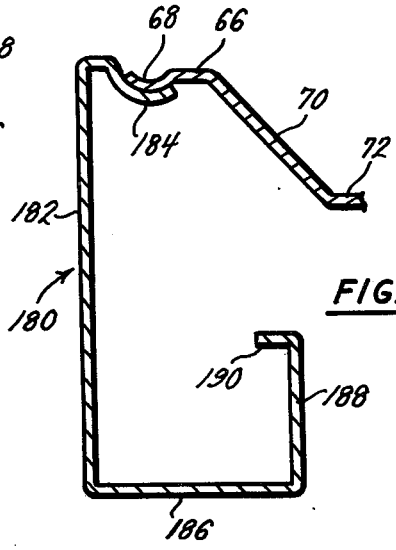
FIG. 14 is a sectional view, on the scale of FIG. 2, through a further portion of the roof of FIG. 1, and it is taken along the plane indicated by the line 14—14 in FIG. 1.

A section of fascia 180 can be used to provide an attractive closure for each end of the roof 44, as indicated by FIGS. 1 and 14. That roof preferably will be dimensioned so each end thereof is constituted by the edge of one-half of a semi-cylindrical concave groove 68 or 88 of a roof pan 46. Where that is done, the generally-arcuate lip 184 of the section of fascia 180 can be set in position to underlie that half-groove. Thereupon, that lip will reinforce and strengthen that half-groove, and also will coact with that half-groove to constitute a shallow gutter. A suitable sheet metal fitting, not shown, will be used to secure one end of the section of fascia 180 to the side of the mobile home 20; and a suitable sheet metal corner fitting, not shown, will be used to secure the lower end of that section of fascia to the fascia at the lower side of the roof 44.

Figure 15:
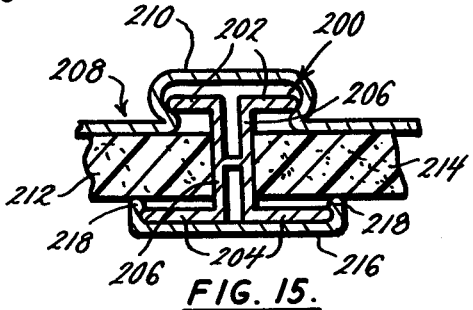
FIG. 15 is a sectional view, on the scale of FIG. 10, and it shows a further embodiment of hanger plus a trim strip usable with that hanger.

Referring particularly to FIG. 15, the numeral 200 denotes a hanger which is I-shaped in cross section and which is short in length. The top flange 202 of that hanger has two laterally spaced portions and, similarly, the bottom flange 204 of that hanger has two laterally-spaced portions. The portions of those flanges are spaced apart by an H-shaped web 206, as shown by FIG. 15. The hanger 200 preferably will be formed as part of an extrusion.

The two portions of the upper flange 202 will have the outer edges thereof spaced apart a distance greater than the narrowest portion of an undercut recess 210 of a roof pan 208, as shown by FIG. 15. However, the cross arm and upper portions of the H-shaped web 206 of that hanger will be sufficiently flexible to enable an installer to use a screw driver or other implement to force the two portions of the upper flange 202 into position with that undercut recess. The consequent restorative forces within that cross arm and those upper portions will be strong enough to prevent accidental separation of that hanger from that undercut recess.

The numeral 212 denotes a sheet of insulation which can be identical to the sheets 160 and 196 of insulation; and the numeral 214 denotes a sheet of insulation which can be identical to the sheets 162 and 198 of insulation. The confronting edges of the sheets 212 and 214 of insulation will abut the outer faces of the H-shaped web 206 of the hanger 200; and they will be underlain by a trim strip 216. That trim strip has lips 218 which will overlie the outer edges of the portions of the bottom flange 204 of the hanger 200. The cross piece and the lower portions of the H-shaped web 206 of that hanger can yield sufficiently to permit the lips 218 of the trim strip 216 to be telescoped upwardly past the outer edges of the portions of that flange and into the position shown by FIG. 15. Thereafter, the restorative forces within that cross piece and those lower portions of that H-shaped web will hold that trim strip against accidental separation from the lower flange 206 of the hanger 200.

The present invention can be seen to provide a simple but sturdy and effective support for the lower side of a roof for a patio or porch, to provide a simple but sturdy and effective support for the upper side of that roof, and to provide light-weight but sturdy and attractive three-dimensional roof pans for that roof. In addition, that invention can be seen to provide an effective and attractive fascia for that roof plus fascia-supporting clips which are easily and solidly secured to the roof pans and to which that fascia can be easily and solidly secured. Moreover, that invention can be seen to provide a simple but sturdy and effective support for sheets of insulation which coact to constitute a ceiling. Furthermore, the invention can be seen to provide an easily-installed but effective weather stop for the spaces defined by the upper edges of the roof pans.

The roof provided by the present invention can be used adjacent permanently-located houses and buildings as well as adjacent mobile homes. Further, the roof provided by the present invention can be made free-standing by providing post-mounted channels or other elongated supporting members beneath both elongated sides of that roof; and, where that is done, a fascia should be provided for both sides as well as both ends of that roof.

If the length of the roof 44 is greater than the length of a single section of flashing-like bracket 30, two or more sections of that flashing-like bracket will be used. The joint between adjacent sections of the flashing-like bracket 30 will be overlain by an essentially-flat plate-like connector, not shown, which has a flat edge and a downwardly-depending re-entrant edge. The flat edge of that connector will be passed through the elongated slot 26 in the supporting bracket 22 and will be disposed in the spaces defined by the flanges 32 and by the longitudinally-extending lips 34 on the adjacent sections of flashing-type bracket 30. The downwardly-depending re-entrant edge of that connector will be fitted around, and will underlie, the adjacent ends of the lips 40 of those adjacent sections of flashing-type bracket. Self-tapping screws will be used to secure that connector to those adjacent sections of flashing-type bracket. That connector will have a length which is less than the distance between the upper ends of the inclined portions 70 and 84 of a roof pan 46; and the joints between adjacent sections of flashing-type bracket 30 will be located between those, or similar, inclined portions. Where that is done, the downwardly-depending re-entrant edge of that connector will not interfere with the intimate engagements between the lower edge of lip 40 and the upper surfaces 66 and 86 of any roof pans 46.

Whereas the drawing and accompanying description have shown and described a preferred embodiment of the present invention, it should be apparent to those skilled in the art that various changes may be made in the form of the invention without affecting the scope thereof.

What I claim is:

1. A roof which has a plurality of elongated supporting members that are generally parallel to each other but that are spaced apart several feet, a plurality of roof pans that are made of thin gauge metal and that are supported only adjacent the ends thereof by said elongated supporting members and hence experience substantial dimensional changes under heavy loads, each of said roof pans having at least one upper portion and at least one lower portion and a plurality of upwardly-directed and downwardly-directed connecting portions which displace said one lower portion horizontally away from, and vertically below the level of, said one upper portion, the upper portions of said roof pans being spaced apart by said upwardly-directed and downwardly-directed connecting portions but coacting together to define a first substantially-planar surface for said roof, the lower portions of said roof pans being spaced apart by said upwardly-directed and downwardly-directed connecting portions but coacting together to define a substantially-planar surface for said roof which is displaced vertically below the level of said first substantially-planar surface, fasteners which secure said lower portions of said roof pans to said elongated supporting members, said lower portions of said roof pans constituting just a small portion of the overall undersurface of said roof, shallow undercut recesses in the undersurfaces of said lower portions of said roof pans which extend upwardly from said first substantially-planar surface, each of said undercut recesses having a depth which is just a small fraction of the overall height of said roof, a plurality of hangers which extend upwardly into, and which are supported by, said undercut recesses, and a plurality of sheets of material which are held by said hangers and which coact to define a ceiling for said roof.

2. A roof which has a plurality of roof pans that provide a plurality of upper portions and a plurality of lower portions and that have shallow undercut recesses in the undersurfaces of said lower portions, each of said undercut recesses defining a narrow elongated slot which communicates with the undersurface of one of said lower portions and hence with the undersurface of said roof, a plurality of hangers which are supported by said undercut recesses and which have lower portions that are disposed below the levels of said undercut recesses, said lower portions of said hangers being elongated and being generally parallel to said narrow elongated slots which are defined by said undercut recesses, and a plurality of sheets of material which are held by said lower portions of said hangers and which coact to define a ceiling for said roof, said lower portions of said hangers underlying the confronting edges of said sheets of material to support said confronting edges, said underlying portions of said hangers concealing the joints between said confronting edges of said sheets of material, said hangers having upwardly-extending portions that extend upwardly from said lower portions to pass up through said narrow elongated slots to be disposed within said undercut recesses, said hangers having laterally-extending surfaces adjacent the upper ends of said upwardly-extending portions that coact with the undercut portions of said undercut recesses to prevent accidental separation of said hangers from said undercut recesses, said confronting edges of said sheets being generally parallel to said narrow elongated slots which are defined by said undercut recesses.

* * * * *